United States Patent [19]

Bucker

[11] 4,306,389

[45] Dec. 22, 1981

[54] PROTECTIVE DEVICE

[76] Inventor: Thomas W. Bucker, 807 Springfield Ave., Cranford, N.J. 07016

[21] Appl. No.: 933,464

[22] Filed: Aug. 14, 1978

[51] Int. Cl.[2] ..... E04D 13/06

[52] U.S. Cl. ..... 52/11

[58] Field of Search ..... 52/11, 94, 16, 15, 97; 14/1

[56] References Cited

U.S. PATENT DOCUMENTS

| | | | |
|---|---|---|---|
| 3,248,827 | 5/1966 | Hardy | 52/97 |
| 3,300,911 | 1/1967 | Riddell | 52/16 |
| 3,967,419 | 7/1976 | Robinson | 52/16 |

FOREIGN PATENT DOCUMENTS

| | | | |
|---|---|---|---|
| 2012637 | 3/1970 | France | 52/94 |
| 980520 | 1/1965 | United Kingdom | 52/94 |

*Primary Examiner*—John E. Murtagh

[57] ABSTRACT

An installed gutter having a main flow channel and an exposed curved front surface including an upper generally vertically disposed surface directly adjacent the flow channel for receiving any overflow from the channel and having disposed at least on the vertical portion a protective strip coating or cover characterized by having nonwater wetting characteristics. This strip may comprise any suitable material such as Teflon, polyethylene, polypropylene and the like. The strip may extend for the entire gutter length or for a predetermined portion or length of the gutter. According to the preferred design, the protective strip is secured to the gutter such that it tightly adheres to the front face of the gutter so that overflow does not seep between the strip and gutter. Other adaptations of this invention include use on bridges, overpasses and the like to prevent icicle formation.

7 Claims, 4 Drawing Figures

PROTECTIVE DEVICE

BACKGROUND OF THE INVENTION

This invention relates generally to a novel and improved protective device or strip for use on gutters or eaves trough, or on bridges and other such overpasses.

In the case of gutters or eaves troughs employed on homes, it is a common place for them to get dirty as water collects and overflows from the gutter. Also, during the winter icicles may form on the gutter which can fall and cause damage to the residents of the home as they pass under. A similar dangerous situation can exist on bridges, overpasses and the like, under which vehicles pass. The appearance of the gutters and troughs, over the course of time can be very unpleasing due to inclement weather and other adverse environmental conditions. Generally the only solution to enhancing their aesthetic appearance is to wash them with detergent, replace or repaint them, all of which is at considerable expense and is only a temporary solution. Thus, there exists a need to provide suitable means which would retain gutters or troughs in a desirable aesthetic appearance and also to assist in extending their life, and which also can be used for preventing the formation of icicles on bridges and the like.

Prior art such as U.S. Pat. No. 3,726,051 has disclosed the concept of providing a protective coating on a gutter prior to its installation, the polyethylene strip which is bonded to the exterior finish is removed once the gutter is installed, thus leaving the gutter totally exposed. U.S. Pat. No. 4,019,290 discloses a separate hinged cover for the gutter, while U.S. Pat. No. 3,592,721 discloses a decorative gutter cover which snaps in place.

SUMMARY OF THE INVENTION

According to the present invention, there is provided a nonwetting protective strip for at least a portion of the front face of a gutter or eaves trough which extends along the entire or a predetermined portion of the gutter length or the length of the bridge or overpass which passes over a roadway or the like. This protective strip is preferably adhered to the front vertical face of the gutter and extends vertically downward so that any overflow from the gutter will flow over the strip and fall to the surface below, without contacting the front face of the gutter, thereby protecting it and also preventing the formation of icicles during cold weather. The protective member may comprise any suitable material such as Teflon, polyethylene, polypropylene and the like, so long as it has a nonwetting water capability. The member can be secured to the face of the gutter in a sealed manner by an adhesive in combination with the conventional means which normally support the gutters in place or by separate fastening means.

The protective device described above also can be easily adapted for use on bridges, etc. to prevent icicle formation and possible damage to vehicles passing below. The strip can be secured to and along the bottom edge by suitable fastening means, e.g. nails, epoxy, etc.

DESCRIPTION OF THE PREFERRED EMBODIMENTS

Figure 1:
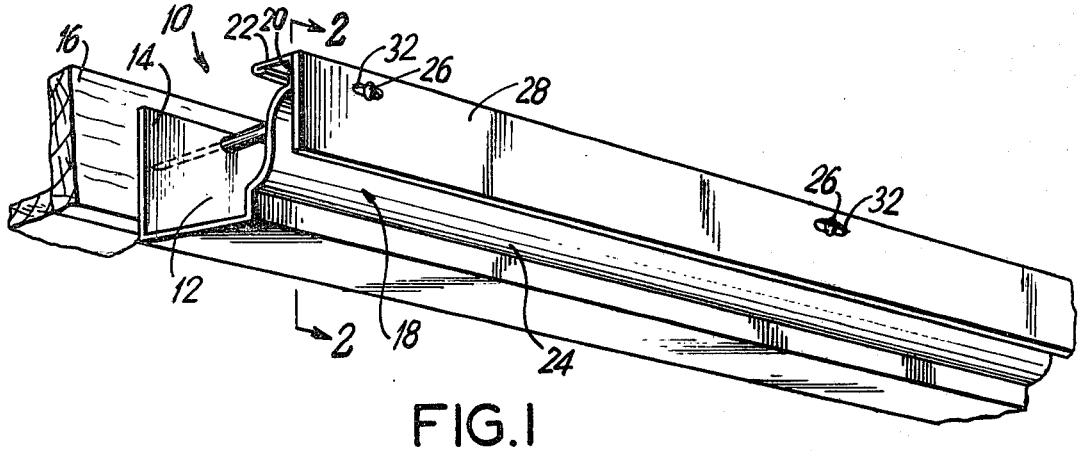
FIG. 1 illustrates a perspective view of the protective strip secured to a standard gutter mounted on the facial board of a home, according to the present invention.
Figure 2:
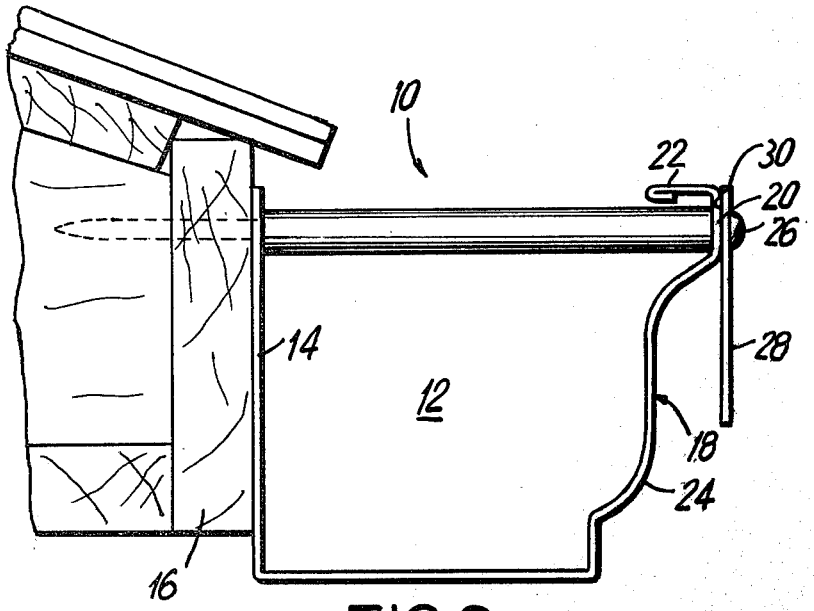
FIG. 2 is a cross-sectional view taken substantially on the line 2—2 of FIG. 1.

With reference to the drawings, the present invention is shown associated with a standard gutter 10 which is normally found secured on the front and around residential homes. The typical gutter comprises a channel 12 through which rain water flows, from which is passes into down spouts (not shown). Each gutter has a rear wall 14 directly adjacent the fascia board 16 and a curved frontal face 18 which can take a variety of shapes. That shown comprises an upper substantially vertical portion 20 directly adjacent the gutter lip 22 and a bottom curved portion 24. The gutter is secured at spaced locations by means of nails 26 or the like which conventionally fasten the gutters to the house. A protective nonwetting strip of material 28 is secured to the vertical face 20. It should be recognized, however, that this latter portion may comprise a variety of orientations such as angularly disposed, etc. The protective strip may include a plurality of preformed spaced openings (e.g. elongated) 32 along its length or it can be secured by the nails already holding the gutter in place. Alternatively or in combination with the nails an adhesive 30 can be disposed on the back surface of the protective strip which will securely seal it to the gutter and prevent any seepage between the strip and the gutter. The protective strip is sufficiently rigid (e.g. 20 mils thick) so that it will extend in a substantially vertical downward direction from the top of the front. It can extend lengthwise for the entire length of the gutter according to the preferred embodiments although it can be selectively placed along the gutter, although it would not serve to completely protect the gutter. Typically, this protective strip can comprise a suitable material characterized by being nonwetting including Teflon, polyethylene or polypropylene. Any water which comes in contact with the strip will not adhere to it, but instead will freely flow along its surface onto the ground surface below. Thus, the front face of the protective strip comprises a free flow surface for any water which comes in contact therewith. The water is directed downwardly and not onto the gutter as in the case of conventional gutters. Also, icicles cannot form on the gutter because the water does not adhere to it.

The preferred range of thickness for the present invention is about 18 mils to about 22 mils and a typical width of the strip thereof would be approximately $1\frac{3}{4}$ in.

Figure 3:
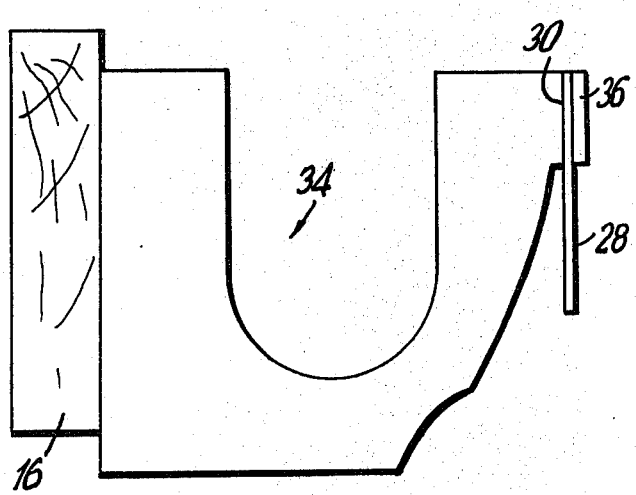
FIG. 3 is another embodiment of the protective strip secured to gutter by separate means, according to the present invention.

FIG. 3 shows the protective strip 28 secured to a standard wooden gutter 34. An outer flat strip of wood 36 can be placed over the protective strip and secured in place, for example, by nailing, screws and the like.

Figure 4:
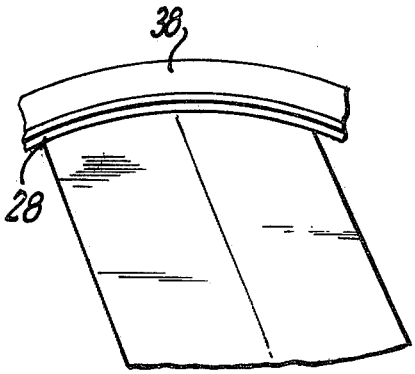
FIG. 4 is still another embodiment of the present invention installed on a bridge overpass.

FIG. 4 illustrates the strip 28 secured to the bottom edge of a bridge overpass 38 or other such structure. This will prevent the formation of icicles along the bottom edge and eliminate a source of possible danger to vehicles passing below on the road or other such passageway.

What is claimed is:

1. A protective strip in combination with a gutter for securement to a structure, said gutter comprising an elongated flow passageway having a bottom, a front face and a rear face, said protective strip having a uniform thickness and a nonwettable front surface over which water from said gutter freely flows and mounted on at least a top portion of said front face of said gutter in tightly sealed relation to the adjacent front face, said strip beginning at and extending downward from the top of said gutter for a predetermined distance which is situated above said bottom, and means for securing said strip only to said front face at said top portion.

2. The combination of claim 1 wherein said protective strip comprises a material selected from the group comprising Teflon, polypropylene and polyethylene.

3. The combination of claim 1 wherein said protective strip is about 20 mils thick.

4. The combination of claim 1 wherein said protective strip is sealed to said front face by an adhesive between said strip and said top portion of said front face.

5. The combination of claim 1 wherein said protective strip is rigid.

6. The combination of claim 1 wherein said protective strip includes a plurality of preformed spaced openings along the length thereof for enabling securement of said protective strip to said gutter by fastening means which secures said gutter to said structure.

7. The combination of claim 1 wherein said protective strip extends vertically down from the top of said gutter for about two inches.

* * * * *